US007559802B2

(12) United States Patent
Hu et al.

(10) Patent No.: US 7,559,802 B2
(45) Date of Patent: Jul. 14, 2009

(54) ELECTRICAL CONNECTORS WITH SEPARATED SHIELDS

(75) Inventors: Peng Hu, Kunshan (CN); Jia-Yong He, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 11 days.

(21) Appl. No.: 12/005,326

(22) Filed: Dec. 26, 2007

(65) Prior Publication Data

US 2008/0153353 A1 Jun. 26, 2008

(51) Int. Cl.
*H01R 9/03* (2006.01)

(52) U.S. Cl. ..... 439/610

(58) Field of Classification Search ..... 439/607–610, 439/571–572, 567

See application file for complete search history.

(56) References Cited

U.S. PATENT DOCUMENTS 5,281,169 A 1/1994 Kiat et al.
5,993,258 A * 11/1999 Matsunuma et al. ..... 439/607
6,183,300 B1 * 2/2001 Belopolsky et al. ..... 439/607
6,416,359 B1 * 7/2002 Zhang et al. ..... 439/607
6,554,648 B2 * 4/2003 Shi et al. ..... 439/607
D527,707 S 9/2006 Lai
2002/0142636 A1 * 10/2002 Murr et al. ..... 439/108

FOREIGN PATENT DOCUMENTS

CN 2744020 12/2005

* cited by examiner

*Primary Examiner*—Jean F Duverne
(74) *Attorney, Agent, or Firm*—Wei Te Chung

(57) ABSTRACT

An electrical connector for mating with a plug includes an insulative housing, a number of contacts retained in the insulative housing, and a shield means covering the insulative housing. The insulative housing defines a receiving space for receiving a mating plug. The shield means includes a first shield with engaging arms extending into the receiving space and a second shield attached to the first shield and without said engaging arms extending into the receiving space. The first shield and the second shield are made of different materials, wherein the material of the first shield is better than that of the second shield.

9 Claims, 5 Drawing Sheets

ELECTRICAL CONNECTORS WITH SEPARATED SHIELDS

BACKGROUND OF THE INVENTION

1. Field of the Invention

The present invention relates to electrical connectors, and more particularly to electrical connectors with separated shields mounted thereon.

2. Description of Related Art

Shielded electrical connector systems are used in many applications, including telecommunications equipment, computers, other digital information systems, and the like. CN. Pat. Issued No. 2744020Y discloses such an electrical connector which includes an insulative housing with a plurality of contacts retained therein and a metal shield enclosing the insulative housing. The insulative housing comprises a base portion and a horizontal tongue extending forwardly from a front face of the base portion. The insulative housing defines a receiving space with the tongue extending therein.

The metal shield includes an upper shield and a lower shield. The upper shield has a top face, a pair of opposite side faces and a rear face. The top face, and the opposite side faces each has a plurality of spring tabs at a front edge thereof for abutting against a device on which the electrical connector mounted to establish a grounding path therebetween. Each of the upper and lower shield also has a pair of engaging arms stamped therefrom, and extending into the receiving space for abutting against a corresponding plug to provide a stable mating status.

Nowadays, in order to provide long times mating cycles with the plug inserted/removable into/from the receiving space, the engaging arms are made of material with excellent mechanical property, such as phosphor bronze. However, under this circumstance, if the engaging arms are integrally stamped from the metal shield as disclosed in the prior art, the other part of the metal shield need use the same material as that of the engaging arms, because each of the upper and lower shield is formed of a one-piece metal sheet. Therefore, the other part of the metal shield except the engaging arms is also made of such excellent and expensive material, thereby increasing the cost of the electrical connector.

Hence, an electrical connector with separated shield is needed to solve the problem above.

BRIEF SUMMARY OF THE INVENTION

Accordingly, an object of the present invention is to provide an electrical connector having separated shields which are made of different material in order to decrease the cost of the electrical connector.

An electrical connector for mating with a plug includes an insulative housing, a plurality of contacts retained in the insulative housing, and a shield means enclosing the insulative housing. The insulative housing comprises a top wall, a bottom wall opposite to the top wall, and a pair of opposite left and right walls. The top wall, the bottom wall and the pair of left and right walls define a receiving space. The insulative housing includes a tongue extending into the receiving space. The shield means comprises a first shield with engaging arms extending into the receiving space and a second shield separated from the first shield and without said engaging arms extending into the receiving space. The first shield and the second shield are made of different materials.

The first shield includes an upper shield covering the top wall of the insulative housing and a shield blade below the bottom wall. The second shield includes a lower shield engaging with the upper shield and the shield blade. The shield blade is disposed on the insulative housing and includes a flange provided with a plurality of resisting portions interfering with the lower shield for providing the electrical contact from electromagnetic interference.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
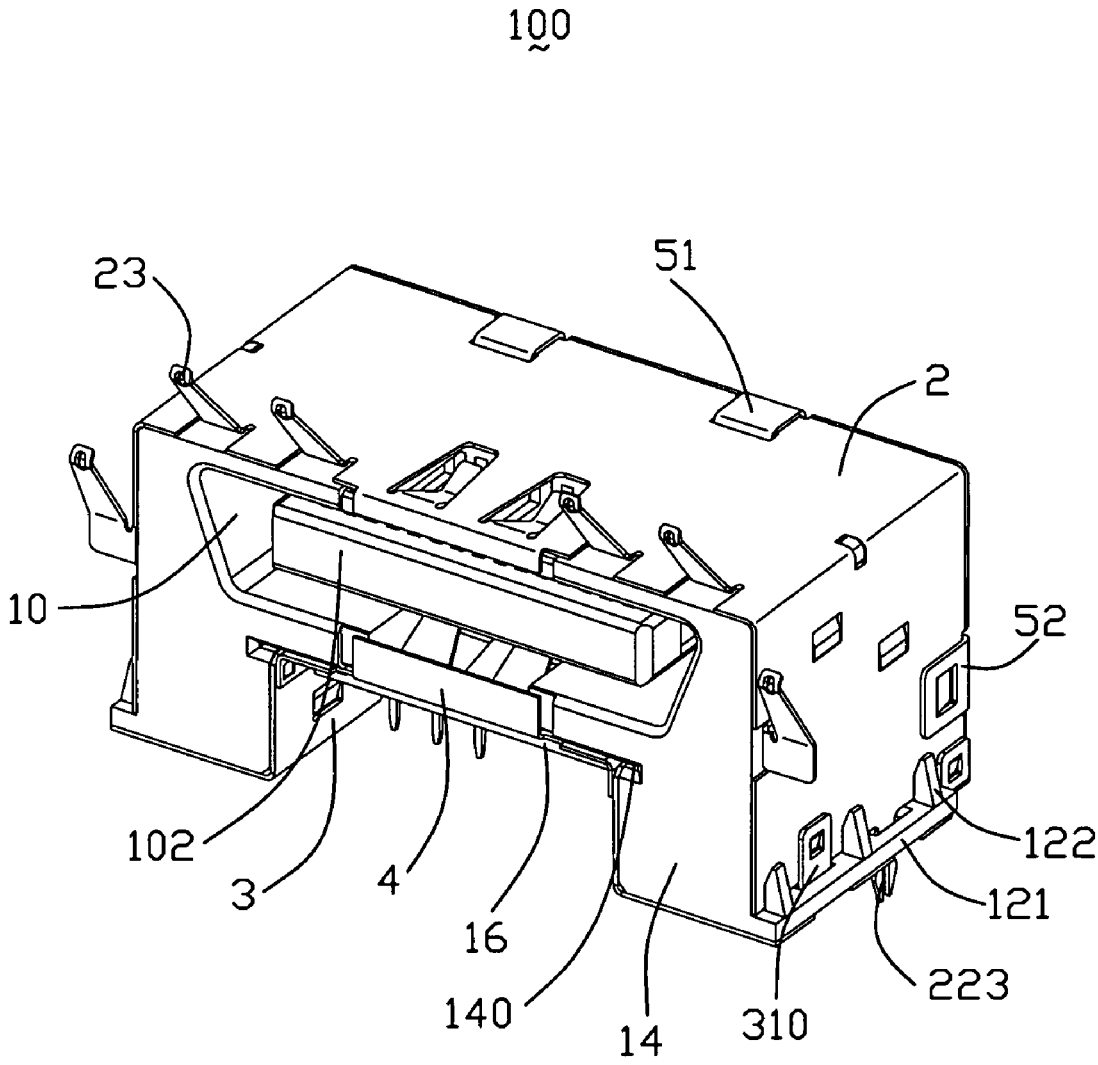
FIG. 1 is a perspective view of the preferred embodiment of an electrical connector according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-4, an electrical connector 100 for mating with a corresponding plug (not shown) is disclosed in accordance with the present invention. The electrical connector 100 comprises an insulative housing 1, a plurality of contacts 6 retained in the insulative housing 1, a spacer 7 disposed on the insulative housing for fixing the contacts 6, a shield means enclosing the insulative housing 1. The shield means includes a first shield and a second shield. The first shield includes an upper shield 2 and a shield blade 4. The second shield includes a lower shield 3 and a rear shield 5 attached to the upper shield 2. The shield blade 4 is assembled in the insulative housing 1 and abuts against the lower shield.

Figure 2:
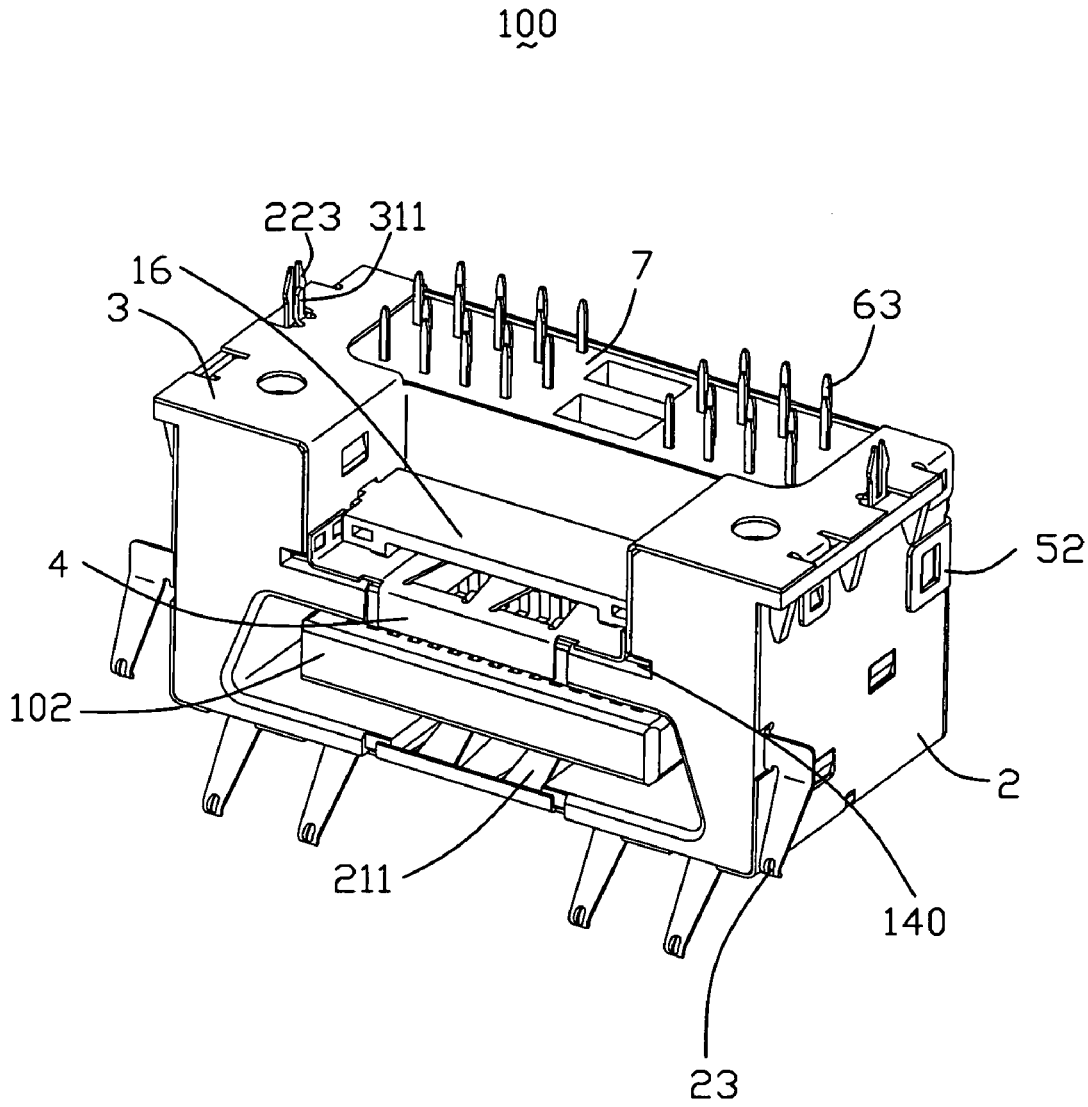
FIG. 2 is another perspective view of the electrical connector shown in FIG. 1, while taken from a different aspect.
Figure 3:
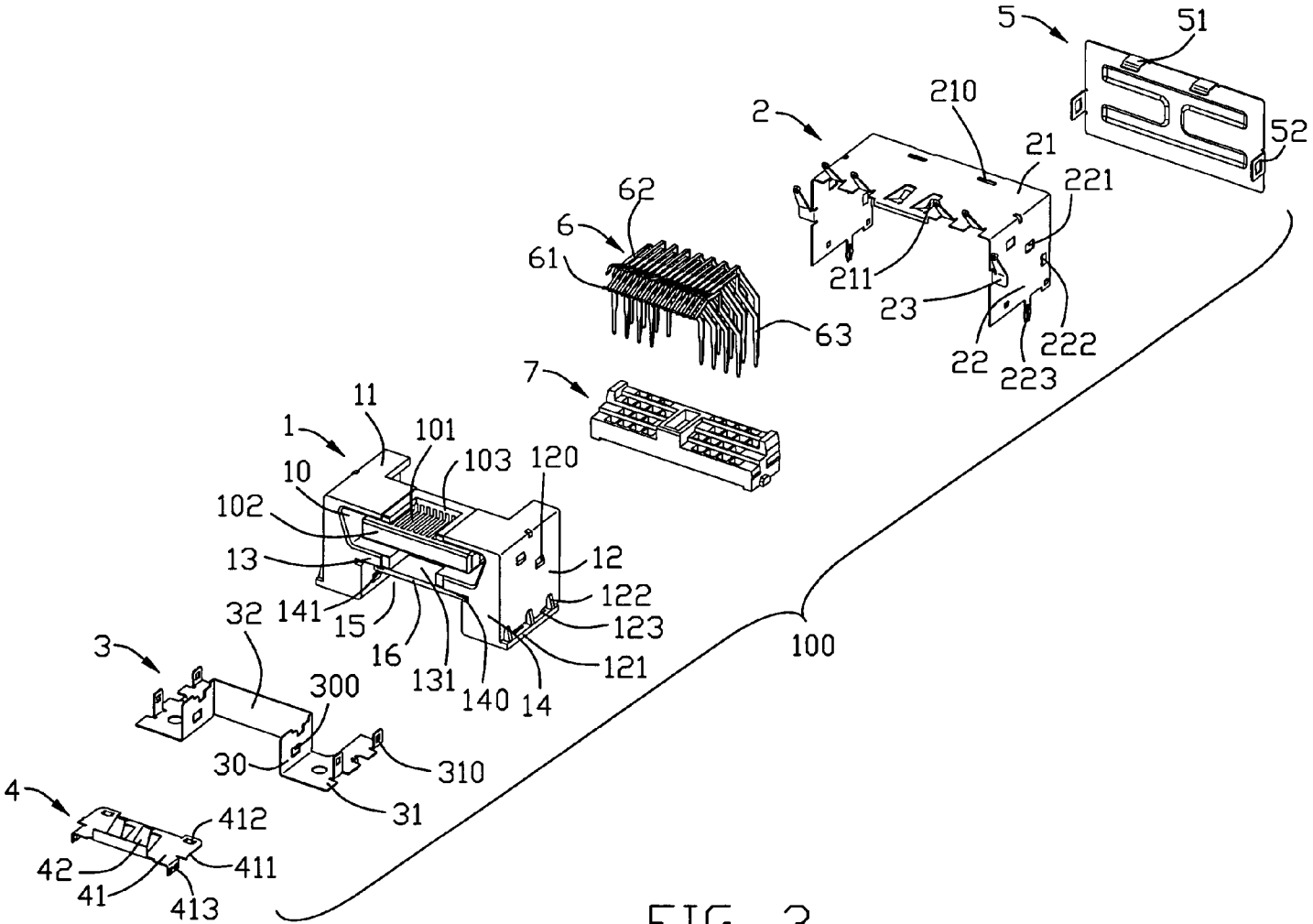
FIG. 3 is an exploded perspective view of the electrical connector shown in FIG. 1.
Figure 4:
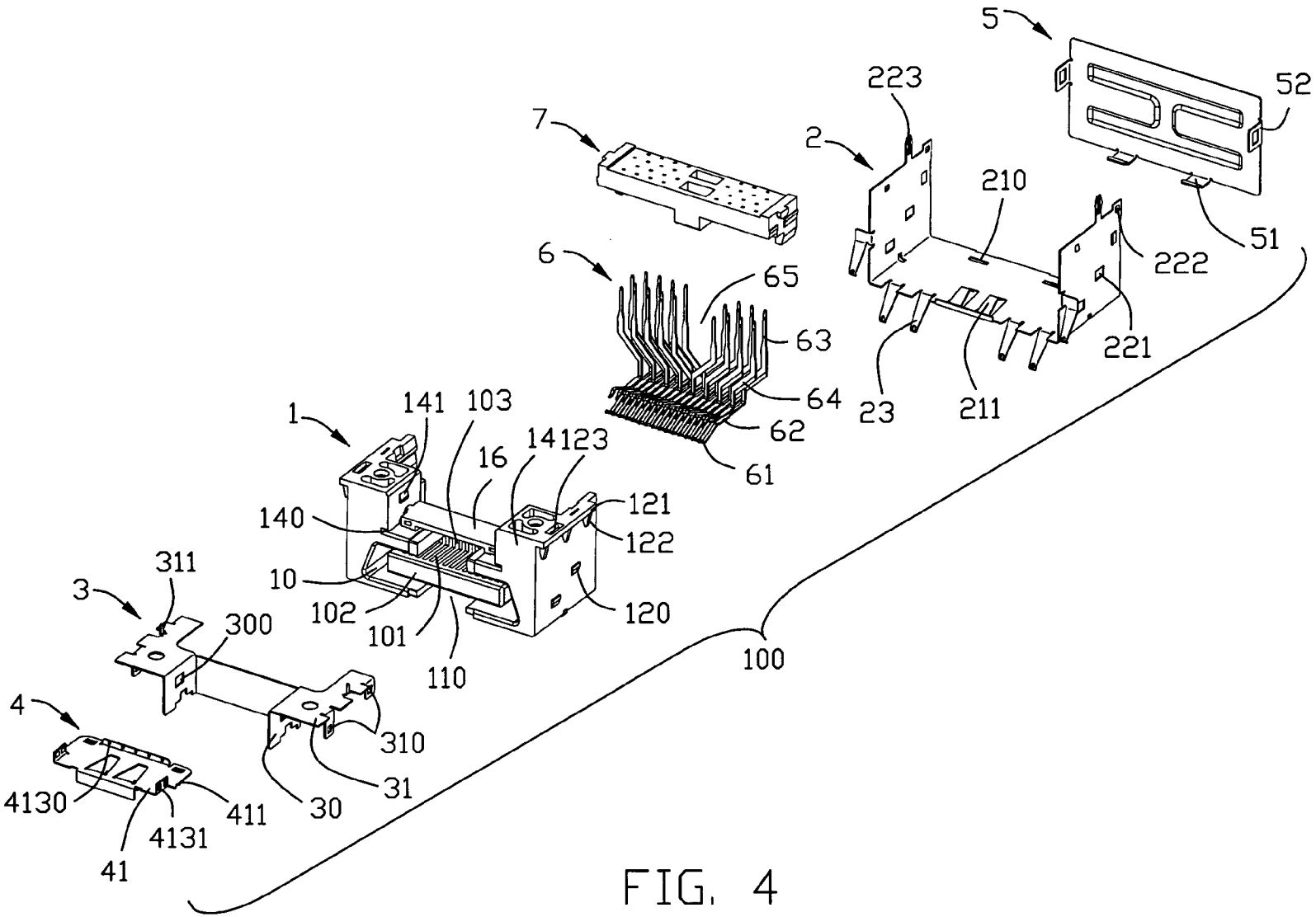
FIG. 4 is a view similar to FIG. 3, while taken from another aspect.

Referring to FIGS. 2 and 3, the insulative housing 1 is made of an insulator material, and has a top wall 11, and a pair of opposite left and right walls 12 adjacent to the top wall 11. A receiving space 10 is formed by the top wall 11 and the left and right walls 12. The insulative housing 1 has a base portion 103 and a tongue 102 integrally extending forwardly from the base portion 103. The tongue 102 defines a plurality of horizontal passageways 101. The base portion 103 has a plurality of grooves 110 communicating with the passageways 101 for receiving the contacts 6 therein.

The insulative housing 1 has a bottom wall 13 opposite to the top wall 11. The top wall 11 and the bottom wall 13 each has an indentation 110, 131 at a front end thereof. The indentations 110, 131 communicate with the receiving space 10. A plurality of protrusions 120 are formed on the left and right walls 12. A pair of supporting posts 14 extend downwardly from a bottom edge of the insulative housing 1 to form a receiving cavity 15 therebetween for receiving a second connector therein. Under the bottom wall 13, a depressor 16 is formed between the supporting posts 14 for pressing the second connector. Therefore the electrical connector 100 and the second connector can be assembled simply. A slot 140 is formed between the supporting posts 14 and the bottom wall 13. Each supporting posts 14 comprises a protrusion 141 at an inner side thereof. A block 121 extends outwardly from a bottom edge of the supporting post 14 provided with a plurality of ribs 122 extending from the block 121. A slit (not labeled) is formed between the ribs 122 and the left and right walls 12 for retaining a lower edge of the upper shield 2. The block 121 has a plurality of holes 123 between the adjacent ribs 122.

Each contacts 6 includes a retaining portion 62, a contact portion 61 extending forwardly from one end of the retaining portion 62, a connecting portion 64 bending downwardly from the other end of the retaining portion 62, and a tail portion 63 extending out of the insulative housing 1 for soldering on a circuit board (not shown). The contact portions 61 are fitted into the passageways 101 of the tongue 102 and extend into the receiving space 10. The retaining portions 62 are fixed into the grooves 110. The contact portion 61 is staggered with the tail portion 62 along a horizontal direction. The tail portions 63 are divided into two groups and define a disjunctive space 65 therebetween.

The upper shield 2 is stamped from a one-piece metal sheet and has a top face 21 and a pair of left and right side faces 22 for covering the top wall 11, left and right walls 12 of the insulative housing 1. The top face 21 is parallel to the tongue 102. A plurality of spring tabs 23 extend upwardly from a front edge of the top face 21, the left and right side faces 22 of the upper shield 2 for abutting against a shell of the device (not shown). The upper shield 2 comprises a plurality of engaging arms 211 extending through the indentation 110 and projecting into the receiving space 10 to abut against the plug (not shown), and a plurality of openings 221 for receiving the protrusions 120 of the indulative housing 1. The top face 21 has a pair of apertures 210. A plurality of tabs 222 is formed on the left and right side faces 22 of the upper shield 2. The rear shield 5 includes a pair of fastening strips 52 extending forwardly for mating with the apertures 210 and a pair of latch strips 51 engaging with the tabs 222 of the upper shield 2. The left and right side faces 22 comprise a pair of mounting legs 223 for mounting the electrical connector 100 on the circuit board (not shown).

Figure 5:
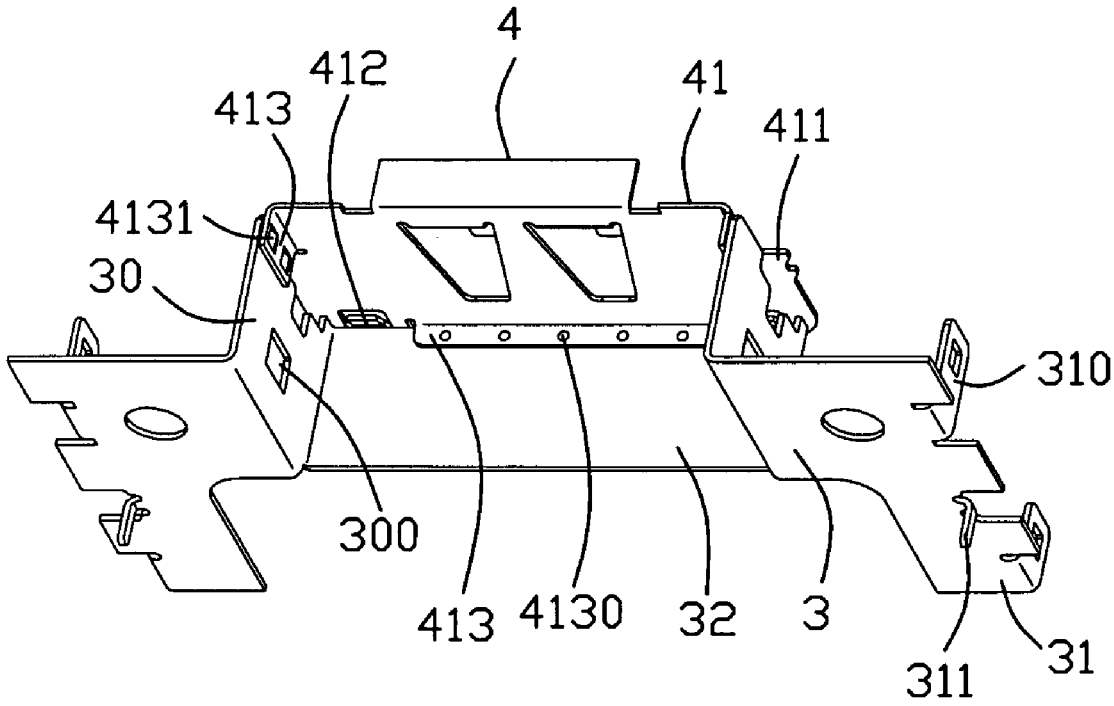
FIG. 5 is an assembled view of the shield blade and the lower shield of the electrical connector.

Referring to FIG. 5, the lower shield 3 is stamped from a second one-piece metal sheet and includes a rear wall 32, a pair of left and right walls 30. Two flanges 31 extend from a bottom edge of the left and right walls 30. A plurality of locking portions 310 extend upwardly from the flanges 31 and run though the holes 123 of the insulative housing 1 for locking with the tabs 222 of the upper shield 2. The left and right walls 30 also defines a plurality of openings 300 to receive the protrusion 141 of the insulative housing 1. A pair of mounting legs 311 extend downwardly from the flanges 31 and locate adjacent to the mounting legs 223 of the upper shield 2.

The shield blade 4 is formed as a plate and arranged between the bottom wall 13 and the depressor 16. The shield blade 4 is parallel to the tongue 102 and comprises a body portion 41 with a pair of engaging arms 42 extending therefrom. The engaging arms 42 run through the indentation 131 and extend into the receiving space 10 for contacting with the plug. A plurality of flanges 413 bend downwardly from the body portion 41 provided with a plurality of resisting portions for interfering with the lower shield 3. The resisting portions include a plurality of tabs 4131 and a plurality of dimples 4130. The tabs 4131 abut against the left and right walls 30 of the lower shield 3 and the dimples 4130 interfere with the rear wall 32 of the lower shield 3. The body portion 41 includes a plurality of agnails 411 fixed into the slot 140 of the insulative housing 1 and a pair of tabs 412 interfering with the insulative housing 1. The resisting portions of the flanges 413 engage with the lower shield 3 for providing the electrical contact from electromagnetic interference.

The spacer 7 is mounted on the insulative housing 1 and located behind the receiving cavity 15 and provided with a plurality of holes for positioning the contacts 6.

According to the present invention, the shield means include two types of shield wherein one type of shield includes engaging arms 211, 42 extending into the receiving space 10 such as the upper shield 2 and the shield blade 4, and the other type of shield does not have engaging arms extending into the receiving space 10 such as the lower shield 3 and the rear shield 5. The two types of shield are separated and made of different materials. The lower shield 3 and the rear shield 5 can be made of common iron sheet while the upper shield 2 and the shield blade 4 can be made of material with excellent mechanical property, such as phosphor bronze in order to provide engaging arms long times mating cycles while mating with the plug. It is obvious that iron is much cheaper than phosphor bronze, thereby, the cost of the electrical connectors 100 is decreased.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing comprising a top wall, a bottom wall, a pair of opposite left and right walls connecting the top wall and the bottom wall that define a receiving space, the insulative housing comprising a tongue extending into the receiving space;

a plurality of contacts retained in the insulative housing, each contact comprising a contact portion disposed on the tongue;

a shield means covering the insulative housing, the shield means comprising a first shield with engaging arms extending into the receiving space, and a second shield being separated from the first shield and without said engaging arms extending into the receiving space, the first shield and the second shield being made of different materials; wherein the first shield comprises an upper shield covering the top wall of the insulative housing, and a shield blade covering the bottom wall and parallel to the tongue, and wherein the upper shield and the shield blade each comprises a pair of engaging arms extending into the receiving space; wherein the shield blade comprises a plurality of agnails interfering with the insulative housing.

2. The electrical connector according to claim 1, wherein the elasticity of the first shield is better than that of the second shield.

3. The electrical connector according to claim 1, wherein the first shield also has a pair of opposite side faces covering the left and right walls of the insulative housing.

4. The electrical connector according to claim 1, wherein the width of the shield blade is essentially equal to the width of the receiving space.

5. The electrical connector according to claim 1, wherein the second shield comprises a lower shield engaging with the upper shield and the shield blade.

6. The electrical connector according to claim 1, wherein the insulative housing has two supporting post extending downwardly and wherein a receiving cavity is formed therebetween for setting a second connector.

7. The electrical connector according to claim 6, wherein a depressor is formed unitarily with the insulative housing between the receiving space and the receiving cavity.

8. An electrical connector, comprising:

an insulative housing comprising a top wall, a bottom wall, and a pair of opposite left and right walls connecting the top wall and the bottom wall that define a receiving space, the insulative housing comprising a tongue extending into the receiving space;

a plurality of contacts retained in the insulative housing, each contact comprising a plurality of contact portions disposed on the tongue;

an upper shield covering the top wall of the insulative housing;

a lower shield attached to the upper shield; and a shield blade covering the bottom wall of the insulative housing and comprising a plurality of resisting portions abutting against the lower shield; wherein the shield blade comprises a flange overlapped with the lower shield and the resisting portions are arranged on the flange; wherein the resisting portions comprise a plurality of tabs abutting against the lower shield; wherein the resisting portions comprise a plurality of dimples abutting against the lower shield; wherein the shield blade comprises a plurality of agnail interfering with the insulative housing.

9. An electrical connector comprising:

an insulative housing comprising a top wall, a bottom wall, a pair of opposite left and right walls connecting the top wall and the bottom wall and commonly defining a receiving space, the insulative housing comprising a tongue extending into the receiving space;

a receiving cavity formed under the bottom wall so as to raise up the receiving space;

a plurality of contacts retained in the insulative housing, each contact comprising a contact portion disposed on the tongue;

a shield blade unit covering the bottom wall;

a bottom cover having two opposite plates covering the bottom face of each of the left and right walls and an inner face of each of the left and right walls, said inner face directly facing said receiving cavity so as to assure said receiving cavity is shielded on at least three sides thereof by said shield blade and said two opposite plates of the bottom cover; wherein said shield blade unit and said bottom cover are discrete from each other; wherein said bottom cover further includes a portion linking said two opposite plates together and covering another side of said receiving cavity; wherein said shield blade unit and said bottom cover commonly form in a cross-sectional vies and upside-down pan.

* * * * *